US011341928B2

(12) United States Patent
Lee et al.

(10) Patent No.: US 11,341,928 B2
(45) Date of Patent: May 24, 2022

(54) DISPLAY DEVICE THAT PROVIDES OVER DRIVEN DATA SIGNALS TO DATA LINES AND IMAGE DISPLAYING METHOD THEREFOR

(71) Applicant: SAMSUNG ELECTRONICS CO., LTD., Suwon-si (KR)

(72) Inventors: Minhoon Lee, Suwon-si (KR); Jaemoon Lee, Suwon-si (KR); Byungkwan Kim, Suwon-si (KR); Changhun Kim, Suwon-si (KR); Sungjin Lim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/258,504

(22) PCT Filed: Apr. 16, 2019

(86) PCT No.: PCT/KR2019/004544
§ 371 (c)(1),
(2) Date: Jan. 7, 2021

(87) PCT Pub. No.: WO2020/022609
PCT Pub. Date: Jan. 30, 2020

(65) Prior Publication Data

US 2021/0295794 A1 Sep. 23, 2021

(30) Foreign Application Priority Data

Jul. 25, 2018 (KR) ..... 10-2018-0086645

(51) Int. Cl.
*G09G 3/36* (2006.01)

(52) U.S. Cl.
CPC ..... *G09G 3/3674* (2013.01); *G09G 3/3648* (2013.01); *G09G 3/3685* (2013.01); *G09G 2310/08* (2013.01)

(58) Field of Classification Search
None
See application file for complete search history.

(56) References Cited

U.S. PATENT DOCUMENTS 7,929,602 B2 4/2011 Kim et al.
9,153,160 B2 10/2015 Hong et al.
(Continued)

FOREIGN PATENT DOCUMENTS

EP 1 286 202 A1 2/2003
JP 5998982 B2 9/2016
(Continued)

OTHER PUBLICATIONS

Time meaning, 2021, www.yourdictionary.com/time, yourdictionary.com, p. 1 (Year: 2021).*
(Continued)

*Primary Examiner* — Kirk W Hermann

(57) ABSTRACT

A display device includes a display panel including a plurality of pixels; a gate driver for applying a gate-on signal through a plurality of gate lines of the display panel; a data driver for applying a data signal through a plurality of data lines of the display panel; and a timing controller for controlling the gate driver and the data driver to display an image frame at a first frame frequency. The display panel is driven at a second frame frequency that is higher than the first frame frequency. The timing controller controls the gate-on signal to be applied to the plurality of gate lines for a time determined on the basis of the second frame frequency, and controls the data driver to apply an over driven data signal to the plurality of data lines.

16 Claims, 6 Drawing Sheets

(56) References Cited

U.S. PATENT DOCUMENTS

| | | | | |
|---|---|---|---|---|
| 9,159,284 | B2 | 10/2015 | Park et al. | |
| 9,426,413 | B2 | 8/2016 | Shishido et al. | |
| 2005/0275611 | A1* | 12/2005 | Aoki | G09G 3/3614 345/96 |
| 2007/0146344 | A1 | 6/2007 | Martin et al. | |
| 2007/0296682 | A1 | 12/2007 | Hwang | |
| 2008/0309593 | A1 | 12/2008 | Ito et al. | |
| 2012/0086737 | A1* | 4/2012 | Tanaka | G09G 3/3406 345/690 |
| 2013/0076769 | A1* | 3/2013 | Park | G09G 3/3648 345/547 |
| 2014/0092145 | A1* | 4/2014 | Park | G09G 3/3611 345/690 |
| 2016/0093262 | A1 | 3/2016 | Choi et al. | |
| 2016/0210927 | A1 | 7/2016 | Cho et al. | |

FOREIGN PATENT DOCUMENTS

| | | | |
|---|---|---|---|
| KR | 10-0851273 | B1 | 8/2008 |
| KR | 10-2013-0034670 | A | 4/2013 |
| KR | 10-2013-0062166 | A | 6/2013 |
| KR | 10-1356164 | B1 | 1/2014 |
| KR | 101356164 | B1 * | 1/2014 |
| KR | 10-1407313 | B1 | 6/2014 |
| KR | 10-2016-0037637 | A | 4/2016 |
| KR | 10-2016-0086491 | A | 7/2016 |
| KR | 10-2017-0073315 | A | 6/2017 |

OTHER PUBLICATIONS

International Search Report (PCT/ISA/210) dated Jul. 26, 2019 by the International Searching Authority in counterpart International Patent Application No. PCT/KR2019/004544.

Written Opinion (PCT/ISA/237) dated Jul. 26, 2019 by the International Searching Authority in counterpart International Patent Application No. PCT/KR2019/004544.

Communication dated Jul. 21, 2021, from the European Patent Office in European Application No. 19839858.8.

* cited by examiner

DISPLAY DEVICE THAT PROVIDES OVER DRIVEN DATA SIGNALS TO DATA LINES AND IMAGE DISPLAYING METHOD THEREFOR

TECHNICAL FIELD

The disclosure relates to a display device and an image displaying method therefor. More particularly, the disclosure relates to a display device which reduces a gate on time of a display panel included in the display device and an image displaying method therefor.

BACKGROUND ART

In general, a display device displays an image on a screen in a sequential driving method. This method may be referred to as a scan method for sequentially driving a gate line (or scan line). The scan method may display information per one gate line in the display panel comprised of a plurality of gate lines.

Specifically, the plurality of cells included in the display panel of the display device may receive a gate on signal from the plurality of gate lines sequentially, and the cells applied with the gate on signal may receive data voltage from the data line.

The cell which received data voltage may charge the received voltage to constantly maintain voltage of the cell while maintaining cell brightness.

That is, based on the brightness of the panel being determined according to the amount of charged voltage, and the amount of charged voltage being determined according to the charge time, the brightness of the display panel may be determined according to the gate on time.

If the number of gate lines of the display panel increases, the driving time for each gate line decreases, and conversely if the number of gate lines are small the driving time for each gate line increases.

According to the related art, because the whole driving time of the gate line has been used as charge time of the cell regardless of the long and short driving time for each gate line, there is the problem of the response rate of the liquid crystal being low by using all of the charge time despite the ability to reduce the charge time of the cell.

DISCLOSURE

Technical Problem

Aspects of the disclosure are to address at least the above-mentioned problems and/or disadvantages, and an object of the disclosure is to provide a display device which reduces response time of the display device to raise a response rate of a liquid crystal and an image displaying method therefor.

Technical Solution

According to an embodiment, a display device includes a display panel including a plurality of pixels, a gate driver to apply a gate on signal through a plurality of gate lines of the display panel, a data driver to apply a data signal through a plurality of data lines of the display panel, and a timing controller configured to control the gate driver and the data driver to display an image frame at a first frame frequency, and the display panel is drivable at a second frame frequency which is higher than the first frame frequency, and the timing controller is configured to control the gate driver to apply the gate on signal to the plurality of gate lines for a time determined based on the second frame frequency, and control the data driver to apply an over driven data signal to the plurality of data lines.

The time in which the data signal is applied may be determined based on the second frame frequency and a number of the plurality of gate lines.

The timing controller may be configured to control the gate driver to sequentially apply the gate on signal to the plurality of gate lines, control the data driver to apply the data signal to pixels applied with the gate on signal from among the plurality of pixels, to display the image frame at the first frame frequency.

The data signal may include a first data signal for over driving of the pixels and a second data signal for pre-charging of the pixels before the over driving.

In addition, the timing controller may be configured to control the gate driver to apply the gate on signal comprised of a plurality of pulses having a predetermined time interval to a gate line, and control the data driver to apply the second data signal to the pixels while pulses excluding a last pulse from among the plurality of pulses are applied to the gate line and apply the first data signal to the pixels while the last pulse is applied to the gate line, and a pulse width of each of the plurality of pulses may be determined based on the second frame frequency.

Further, the timing controller may be configured to control the gate driver to provide the gate on signal having a specific pulse width to the gate line, and control the data driver to apply the second data signal to the pixels for a first time section from among the time in which the gate on signal is applied to the gate line and apply the first data signal to the pixels for a second time section excluding the first time section, and a length of the first time section may be determined based on the first frame frequency.

In addition, the timing controller may be configured to control the gate driver to provide the gate on signal having a specific pulse width to the gate line, and control the data driver to apply the second data signal to the pixels for a first time section from among the time in which the gate on signal is applied to the gate line and apply the first data signal to the pixels for a second time section excluding the first time section, and a length of the first time section may be determined based on the second frame frequency.

According to an embodiment of the disclosure, an image displaying method of a display device including a display panel which includes a plurality of pixels, the displaying method includes applying a gate on signal through a plurality of gate lines of the display panel, and applying a data signal through a plurality of data lines of the display panel to display an image frame at a first frame frequency, and the display panel is drivable at a second frame frequency which is higher than the first frame frequency, and the displaying includes applying the gate on signal to the plurality of gate lines for a time determined based on the second frame frequency, and applying an over driven data signals to the plurality of data lines.

The time in which the data signal is applied may be determined based on the second frame frequency and a number of the plurality of gate lines.

The applying may include sequentially applying the gate on signal to the plurality of gate lines, and the displaying may include applying the data signal to the pixels applied with the gate on signal from among the plurality of pixels.

The data signal may include the first data signal for over driving of the pixels and a second data signal for pre-charging of the pixels before the over driving.

In addition, the applying may include applying the gate on signal comprised of a plurality of pulses having a predetermined time interval to a gate line, the displaying may include applying the second data signal to the pixels while pulses excluding a last pulse from among the plurality of pulses is applied to the gate line, and applying the first data signal to the pixels while the last pulse is applied to the gate line, and a pulse width of each of the plurality of pulses may be determined based on the second frame frequency.

Further, the applying may include applying the gate on signal having a specific pulse width to a gate line, the displaying may include applying the second data signal to the pixels for a first time section from among the time in which the gate on signal is applied to the gate line, and applying the first data signal to the pixels for a second time section excluding the first time section, and a length of the first time section may be determined based on the first frame frequency.

In addition, the applying may include applying the gate on signal having a specific pulse width to a gate line, the displaying may include applying the second data signal to the pixels for a first time section from among the time in which the gate on signal is applied to the gate line, and applying the first data signal to the pixels for a second time section excluding the first time section, and a length of the first time section may be determined based on the second frame frequency.

Effect of Invention

An aspect of the disclosure is to reduce gate on time of cells included in the display panel to increase response rate of liquid crystal included in the display panel and minimize screen blurring.

DETAILED DESCRIPTION OF EXEMPLARY EMBODIMENTS

[Form for Implementation of Embodiments]

Figure 1:
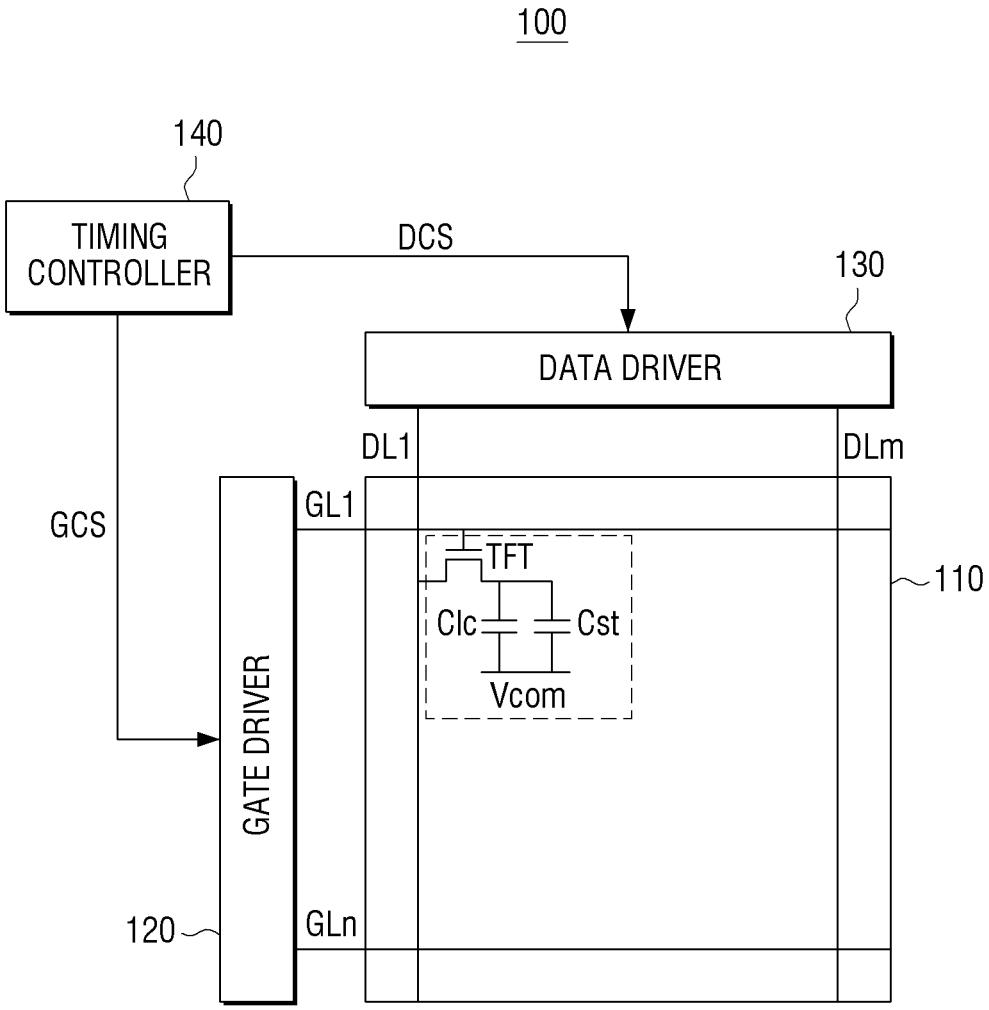
FIGS. 1 and 2 are block diagrams illustrating a configuration of a display device according to an embodiment.

Terms used in the disclosure will be briefly described, and the various embodiments of the disclosure will be described in detail.

The terms used in the embodiments of the disclosure are general terms currently widely used which have been identified in consideration of the functions in the disclosure. However, these terms may vary depending on intention, legal or technical interpretation, emergence of new technologies, and the like of those skilled in the related art. Also, there may be some terms arbitrarily identified by an applicant, and in this case the meaning thereof will be described in detail in the description part of the corresponding disclosure. Accordingly, the terms used herein may be construed, not simply by their designations, but based on the meaning of the term and the overall content of the disclosure.

Because various modifications may be made to the embodiments of the disclosure and the disclosure may have various embodiments, specific embodiments have been illustrated in the drawings and the descriptions will be provided in detail in the description. However, it should be noted that the various embodiments are not for limiting the scope of the disclosure to a specific embodiment, but should be interpreted to include all modifications, equivalents and/or alternatives of the embodiments. In describing the embodiments, in case it is determined that the detailed description of related known technologies may unnecessarily confuse the gist of the disclosure, the detailed description will be omitted.

Terms such as "first," "second," or so on may be used to describe the various embodiments, but the elements may not be limited by the terms. The terms may be used only to distinguish one element from another element.

A singular expression may include a plural expression, unless otherwise specified. It is to be understood that the terms such as "comprise" or "include" are used herein to designate a presence of a characteristic, number, step, operation, element, component, or a combination thereof, and not to preclude a presence or a possibility of adding one or more of other characteristics, numbers, steps, operations, elements, components or a combination thereof.

The terms "module" or "part" used in the embodiments herein perform at least one function or operation, and may be implemented as a hardware or software, or a combination of hardware and software. Further, a plurality of "modules" or a plurality of "parts", except for a "module" or a "part" which needs to be implemented to a specific hardware, may be integrated to at least one module and implemented in at least one processor (not shown).

The embodiments of the disclosure have been described in detail with reference to the attached drawings below to assist those of ordinary skill in the art to easily understand the disclosure. However, the disclosure may be implemented to various different forms and is not limited to the embodiments described herein. Parts unrelated to the description has been omitted to more clearly describe the embodiments of the disclosure, and like reference numerals have been affixed to indicate like components throughout the disclosure.

The various embodiments of the disclosure will be described in detail with reference to the drawings below.

FIG. 1 is a block diagram of a display device according to an embodiment of the disclosure.

Referring to FIG. 1, the display device 100 may include a display panel 110, a gate driver 120, a data driver 130, and a timing controller 140.

The display panel 110 may be implemented as a liquid crystal display panel. In this case, the display panel 110 may include a plurality of pixels formed at a point at which a plurality of data lines DL1 to DLm and a plurality of gate lines GL1 to GLn, and a plurality of data lines DL1 to DLm and a plurality of gate lines GL1 to GLn intersect. Each pixel may include a liquid crystal (or, liquid crystal cell), a transistor (a thin film transistor (TFT)), and a liquid crystal capacitor Clc and a storage capacitor Cst connected to a transistor.

In this case, the transistor may be turned-on when a gate on signal (or, gate on voltage) is applied to the transistor through the gate line, and then, a data signal (or, data voltage) corresponding to a gray scale value of an image frame may be applied through the data line, and the data signal may be charged to the liquid crystal capacitor and the storage capacitor via the transistor.

Accordingly, the liquid crystals may move and twist according to the size of the charged voltage, and based on the degree of the movement and twisting, light transmittance rate irradiated through a back light (not shown) of the display device 100 may be adjusted, and an image frame may be displayed through the display panel 110.

The gate driver 120 may apply the gate on signal through the plurality of gate lines GL1 to GLn of the display panel. Then, the data driver 130 may apply the data signal through the plurality of data lines DL1 to DLm of the display panel.

The timing controller 140 may control the gate driver 120 and the data driver 130 to cause the display 110 to display an image frame.

Specifically, the timing controller 140 may control the gate driver 120 and the data driver 130 to cause the image frame to be displayed at a first frame frequency of the display panel 110.

In this case, the plurality of pixels may include a plurality of liquid crystals capable of driving at a second frame frequency.

The first frame frequency may be smaller than the second frame frequency, and in an example, the first frame frequency may be 60 Hz, and the second frame frequency may be 120 Hz.

First, the liquid crystals being drivable at the second frame frequency may refer to liquid crystals being able to maximally display image frames of a number corresponding to the second frame frequency for one second, and this may be determined according to a characteristic of the liquid crystal, that is, a response rate. Like the above-described example, based on the liquid crystal being drivable at 120 Hz, the display panel 110 may be able to display 120 image frames for one second through the liquid crystal.

The timing controller 140 may control the gate driver 120 and the data driver 130 to cause the display panel 110 to display an image frame at the first frame frequency.

To this end, the timing controller 140 may control the gate driver 130 to apply the gate on signal to the plurality of gate lines sequentially.

The time difference in which the gate on signal is applied sequentially to the plurality of gate lines may be determined based on the first frame frequency and the number of the plurality of gate lines, and the detailed description thereof will be provided below.

Then, the timing controller 140 may control the data driver 130 for the data signal to be applied to the pixels applied with the gate on signal from among the plurality of pixels, and display the image frame at the first frame frequency.

The data signal may include a first data signal for over driving of the pixels and a second data signal for pre-charging of the pixels before the over driving.

The over driving may refer to a technology of expressing a gray scale of an image frame by applying a voltage greater than a voltage corresponding to the gray scale of the image frame for enhancing the response rate of the liquid crystal. Based on the over driving technology being known, the detailed description will be omitted.

As described above, according to an embodiment of the disclosure, while the liquid crystals of the display panel 110 may be drivable at the second frame frequency, the image frame may be displayed at the first frame frequency through the corresponding liquid crystals.

In this case, according to an embodiment of the disclosure, compared to a specific case, rather than reducing the time in which the data signal for over driving is applied, the over driving may be performed by using the data signal having a larger value.

The specific case referred herein may mean displaying the image frame at the first frame frequency through the display panel including liquid crystals which are drivable at the first frame frequency.

That is, according to an embodiment of the disclosure, the time in which the data signal for over driving is applied to the pixels applied with the gate signal may be reduced in that the liquid crystals have a high response rate compared to the specific case and that the liquid crystals may be driven in a relatively short time. In order to express the desired gray scale through over driving, a voltage of a specific size is to be applied to the corresponding pixels while the data signal for over driving is applied. Accordingly, taking into consideration the time saved by about the time in which the data signal for over driving is applied, the data signal for the over driving having a greater value may be applied to the pixels applied with the gate on signal compared to the specific case.

According to an embodiment of the disclosure, the response rate may be increased by maximally utilizing the over driving, and a screen blurring (i.e., motion blur) phenomenon may be minimized in terms of displaying the image frame by using the liquid crystals drivable at the second frame frequency.

As described above, the time in which the data signal for over driving is applied according to an embodiment of the disclosure may be smaller than the time in which the data signal for over driving is applied in the above-described specific case, and at this time, the time in which the data signal for over driving is applied according to an embodiment of the disclosure may be determined based on the second frame frequency.

In this case, the timing controller 140 may control the gate driver to cause the gate on signal to be applied to the plurality of gate lines for the time determined based on the second frame frequency, and control the data driver to cause the over driven data signal to be applied to the plurality of data lines.

The time in which the data signal is applied may be determined based on the second frame frequency and the number of the plurality of gate lines.

For example, the gate line may be 2160, and the image frame may be displayed at a 120 Hz frame frequency.

Because a one image frame may be displayed per $1/120$ second, in order to display one image frame through 2160 gate lines, the data signal for over driving may be applied for $(1/120)/(2160)$=about 3.8 μs per each gate line.

The time in which the data signal for over driving is applied may be determined further considering a blank time.

The blank time may, in terms of displaying an image frame, refer to time spent until applying a first gate on signal to the gate line for displaying the received image frame after the timing controller 140 receives the image frame information.

Accordingly, taking into consideration the blank time, the time in which the data signal for over driving may be applied per each gate line may be smaller than about 3.8 μs.

In this case, to take into consideration the blank time, the time in which the data signal for over driving may be applied may be determined by using the above-described method assuming that the gate line is 20% more than 2160, and in this case, it may be determined as $(1/120)/(2160*1.2)$=about 3.6 μs As described above, the first data signal, that is, the time in which the data signal for over driving is applied may be determined based on the second frame frequency and the number of gate lines. However, this is merely one embodiment, and in some cases, the time in which the data signal for over driving is applied may be smaller than the about 3.6 μs.

Accordingly, the timing controller 140 may control the gate driver 120 and the data driver 130 to cause the display panel 110 to display the image frame at the first frame frequency.

In this case, the timing controller 140 may apply the first data signal for expressing the gray scale of the image frame through over driving to the plurality of data lines for the time determined based on the second frame frequency.

Herein, the first frame frequency may be 60 Hz, and the second frame frequency may be 120 Hz.

First, the timing controller 140 may control the gate driver 120 to sequentially apply the gate signal to the plurality of gate lines.

In this case, the gate signal may include the gate on signal for turning-on a gate of a transistor connected to the gate line, and while the gate is being turned-on by the gate on signal, the data signal may be input to a capacitor through the transistor.

According to an embodiment of the disclosure, in terms of displaying the image frame at a frame frequency of 60 Hz, the timing controller 140 may apply the gate on signal sequentially to the plurality of gate lines at a time difference of about 7.2 μs(=2*3.6 μs).

The timing controller 140 may control the data driver 130 to apply the data signal to the pixels applied with the gate signal from among the plurality of pixels.

The timing controller 140 may apply the second data signal for pre-charging the voltage to the capacitor for a predetermined time from among the time section to which the gate on signal is applied with respect to each gate line, and apply the first data signal for over driving for a predetermined time thereafter.

To apply the second data signal for over driving, the time section to which the gate on signal is applied may be about 3.6 μs as described above.

To apply the second data signal for pre-charging, the time section to which the gate on signal is applied may be variously set, and the various embodiments related thereto will be described below with reference to FIGS. 3 to 5.

Accordingly, the timing controller 140 may control the gate driver and the data driver so that the plurality of pixels included in the display panel 110 displays an image according to the first frame frequency, but the corresponding pixel to be driven at the second frame frequency.

Figure 2:
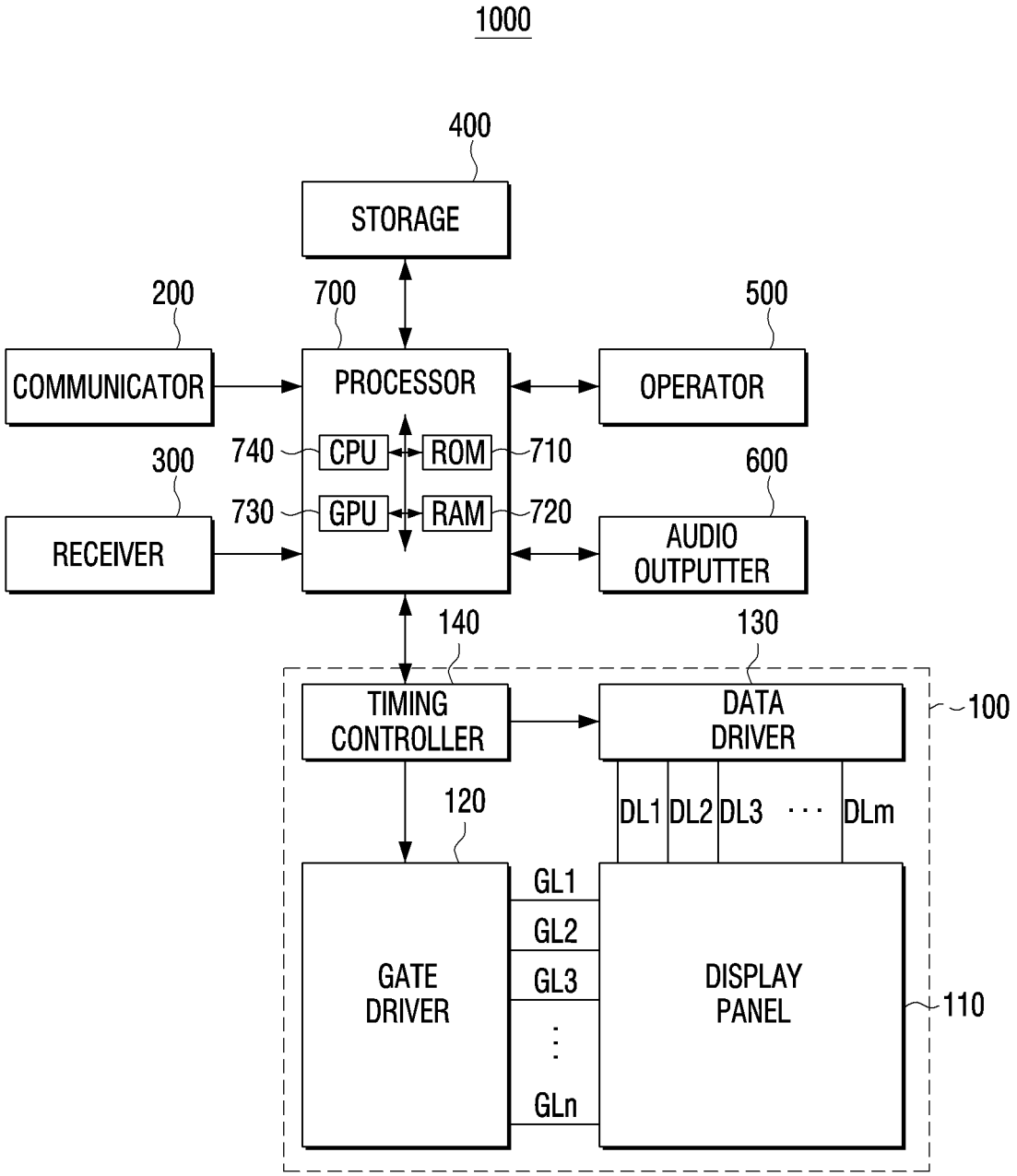

FIG. 2 is a block diagram illustrating a detailed configuration of a display device according to an embodiment of the disclosure.

Referring to FIG. 2, the display device 1000 may include a display panel 110, a gate driver 120, a data driver 130, a timing controller 140, a communicator 200, a receiver 300, a storage 400, an operator 500, an audio outputter 600, and a processor 700.

In describing FIG. 2, the redundant detailed description of the display panel 110, the gate driver 120 the data driver 130, and the timing controller 140 will be omitted for being the same as what was described in FIG. 1.

The communicator 200 may perform communication with the external device. Then, the communicator 200 may transmit and receive various data with the external device (not shown).

In this case, the communicator 200 may perform communication with the external device (not shown) through a communication method of various types. For example, the communicator 200 may use a communication module and perform communication with the external device (not shown) according to communication standards such as Bluetooth and Wi-Fi.

The receiver 300 may receive and demodulate broadcasts from a broadcasting company or a satellite by way of wired or wireless method. Specifically, the receiver 300 may receive and demodulate transmission streams through an antenna or a cable and output a digital transmission stream signal. In this case, the receiver 300 may be implemented in a form including configurations such as a tuner (not shown), a demodulator (not shown), and the like. However, this is merely one embodiment, and the receiver 300 may be implemented to various forms according to the embodiment.

The storage 400 may store image content. Specifically, the storage 400 may receive and store image content with image and audio compressed from an audio processor (not shown) and a video processor (not shown), and output stored image content to the audio processor (not shown) and video processor (not shown) based on the control of the processor 700. The storage 400 may be implemented as a hard disk, a non-volatile memory, a volatile memory, or the like.

The operator 500 may be implemented as a touch screen, a touch pad, a key button, a keypad, or the like, and provide user operation of the display device 1000. In the embodiment, an example of receiving a control instruction through the operation 500 provided in the display device 1000 has been described, but the operator 500 may receive user operation from an external control device (e.g., remote controller).

The audio outputter 600 may perform signal processing such as decoding with respect to audio data input from the receiver 300 and the storage 400, and output the audio data. The audio outputter 600 may be implemented as a speaker or the like.

The processor 700 may control the overall operation of the display device 1000. For example, the processor 700 may drive an operating system or an application to control hardware or software elements connected to the processor 700, and perform various data processing and calculations. In addition, the processor 700 may load and process instructions or data received from at least one from among other elements to the volatile memory, and store various data to the non-volatile memory.

To this end, the processor 700 may be implemented, by executing one or more software programs stored in a dedicated processor (e.g., embedded processor) for performing the corresponding operation or a memory device, as a generic purpose processor (e.g., CPU or application processor) capable of performing the corresponding operations.

The processor 700 may transmit image data received from the external device (not shown) to the display panel 110 through the communicator 200 or store in the storage 400. Specifically, the processor 700 may perform signal processing such as decoding or the like on the image data input from the receiver 300 and the storage 400, and output the image data to the timing controller 140.

The processor 700 may control the timing controller 140 to cause the display panel 110 which includes the plurality of pixels drivable at the second frame frequency to display the image frame at the first frame frequency.

To this end, the processor 700 may perform over driving of the pixels of the display panel and control the timing controller 140 so that the response time of the liquid crystal cell may be reduced.

The processor 700 may include a ROM 710, a RAM 720, a graphics processing unit (GPU) 730, a CPU 740, and a BUS. The ROM 710, the RAM 720, the GPU 730, the CPU 740, or the like may be interconnected through the BUS.

The CPU 740 may access the storage 400, and perform booting by using an operating system (O/S) stored in the storage 400. Then, the CPU 740 may perform various operations by using the various programs, content, data, or the like stored in the storage 400. This operation of the CPU 740 may be the same as the operations of the processor 700 described above, and redundant descriptions will be omitted.

The instruction set or the like for system booting may be stored in the ROM 710. When a turn-on instruction is input and power is supplied, the CPU 740 may copy the O/S stored in the storage 400 to the RAM 720 based on the instruction stored in the ROM 710, and boot the system by executing the O/S. When booting is complete, the CPU 740 may copy the various programs stored in the storage 400 to the RAM 720, and execute the program copied to the RAM 720 to perform various operations.

The GPU 730 may generate a screen including various objects such as an icon, an image, a text, or the like when the booting of the display device 1000 is complete.

In the above-described example, the processor 700 may be included in the main board, and the timing controller 140 may be included in a TCON board. However, this is merely one example, and in case the main board and the TCON board are integrated and implemented, the processor 700 and the timing controller 140 may be included in the same board.

Figure 3:
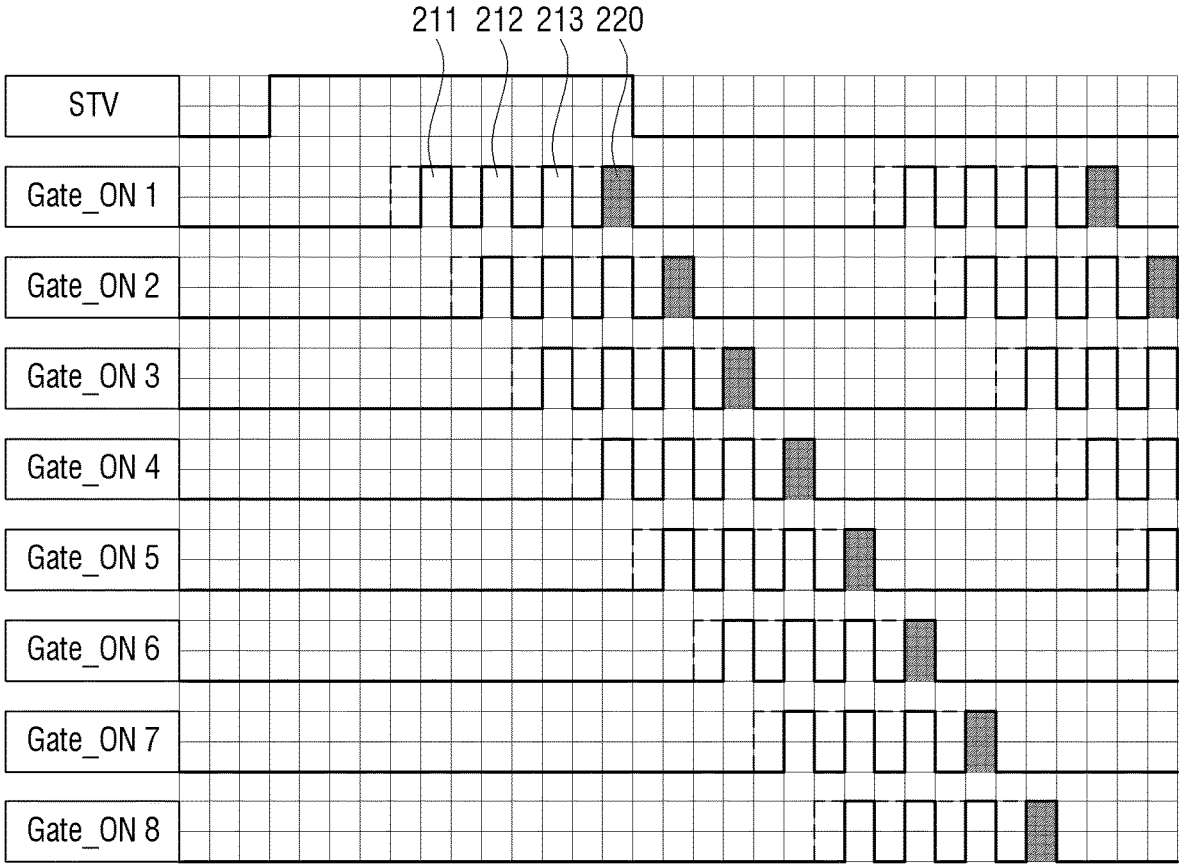
FIGS. 3 to 5 are diagrams illustrating a signal applied to a gate line and a data line according to various embodiments.
Figure 4:
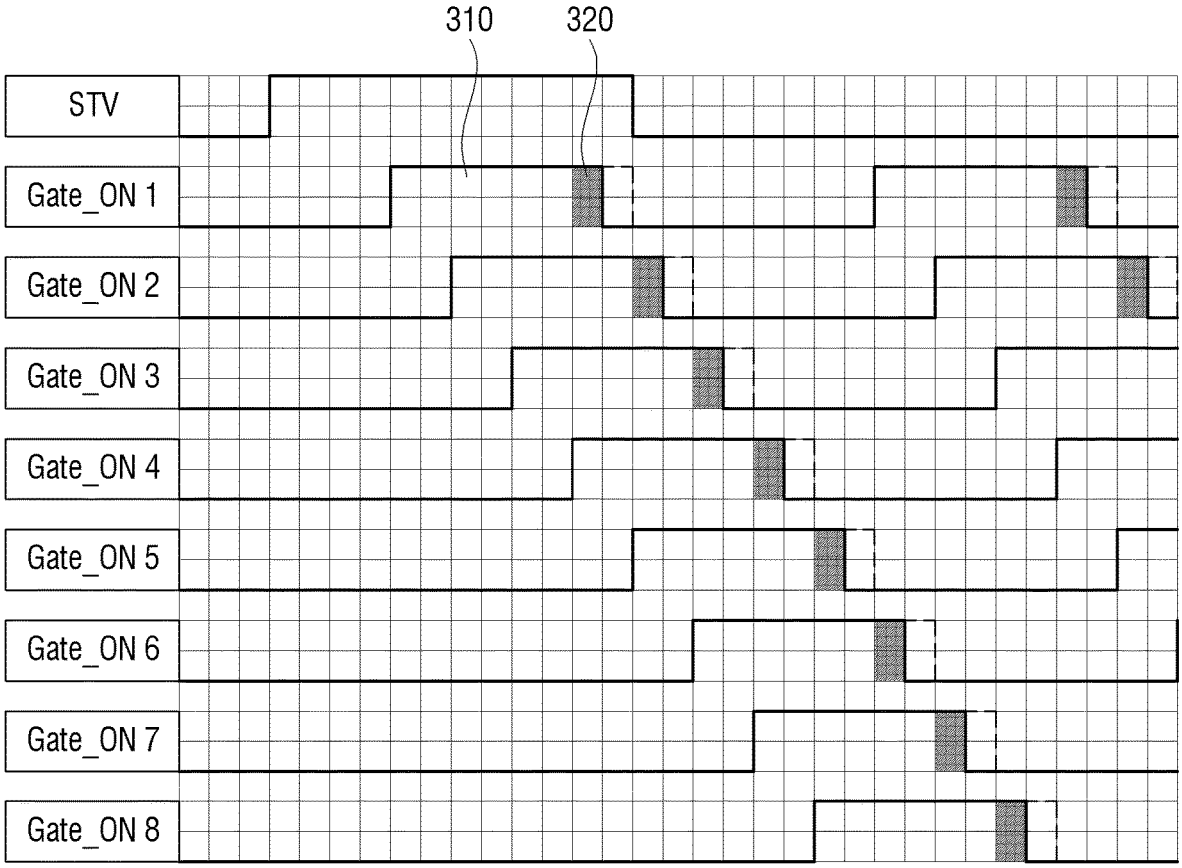
Figure 5:
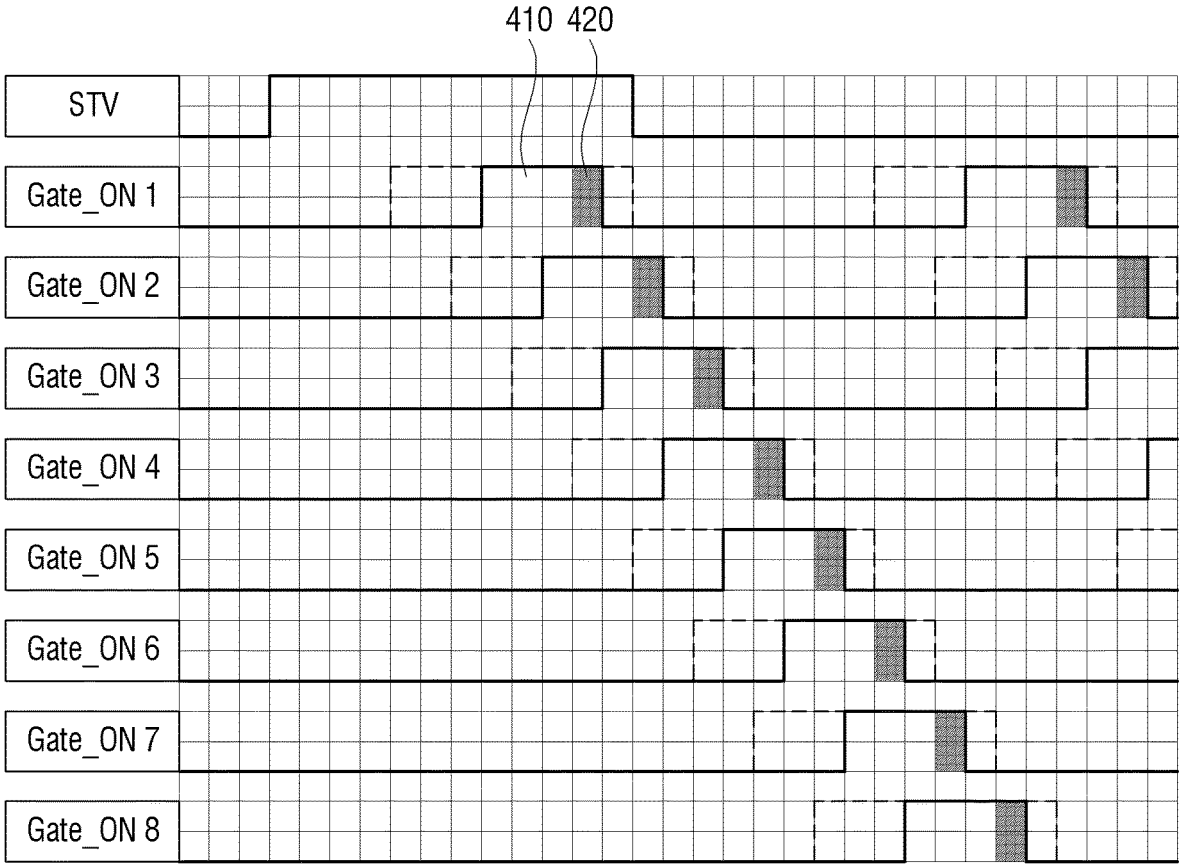

FIGS. 3 to 5 are diagrams illustrating a signal applied to a gate line and a data line according to various embodiments of the disclosure.

Specifically, FIGS. 3 to 5 are diagrams illustrating a gate on signal and a data signal which are to be applied to a pixel of a display panel 110, which displays an image frame at a first frame frequency (e.g., 60 Hz), and is driven at a second frame frequency (e.g., 120 Hz).

First, FIG. 3 is a diagram illustrating a case of a gate on signal in which a pulse width is determined based on the second frame frequency being applied to a gate line.

The timing controller 140 may control the gate driver 120 to apply the gate on signal comprised of a plurality of pulses having a predetermined time interval to the gate line, and control the data driver 130 to apply the second data signal to the pixels while the remaining pulses excluding the last pulse from among the plurality of pulses are being applied to the gate line and apply the first data signal to the pixels while the last pulse is being applied to the gate line.

To this end, first, before displaying a one image frame to the display panel 110, the timing controller 140 may transfer a vertical start signal (STV) to the gate driver 120.

When the timing controller 140 transfers the vertical start signal (STV) to the gate driver 120, the gate driver 120 may sequentially apply the gate on signal to the gate line from the point in time of having received the vertical start signal (STV) to until after the pre-set time is passed.

Specifically, the gate driver 120 may sequentially apply the gate on signal comprised of the plurality of pulses having a predetermined time interval to the plurality of gate lines as in FIG. 3.

The pulse width of each of the plurality of pulses may be determined based on the second frame frequency.

For example, the gate driver 120 may apply gate on signals 211, 212, 213 and 220 to the first gate line from among the 2160 gate lines, and the pulse width of the gate on signal may be about 3.6 μs, respectively.

Then, the gate driver 120 may apply, after a predetermined time has passed, that is, after about 7.2 μs has passed, a gate on signal which is the same as the gate on signal applied to the first gate line to the second gate line. In this method, the gate driver 120 may sequentially apply the gate on signal to 2160 gate lines in total.

As illustrated in FIG. 3, the gate driver 120 may generate 8 gate on signals, and by way of sequentially applying per each 8 gates lines, apply the gate on signal to 2160 gate lines in total.

The data driver 130 may apply, during the time the gate is being turned-on by the gate on signal, the data signal through the plurality of data lines.

The data signal may include the first data signal for over driving and the second data signal for pre-charging.

For example, as in FIG. 3, the gate on signals 211, 212, 213 and 220 may be applied to each gate line, and the data driver 130 may, at this time, apply the second data signal for pre-charging while the gate on signals 211, 212 and 213 are being applied, and while the gate on signal 220 is being applied, apply the first data signal for over driving.

The size of the first data signal for over driving may be varied according to the gray scale value displayed in the pixel, and the size of the first data signal according to the gray scale may be predetermined and pre-stored in the storage 400.

Meanwhile, based on the gate on signal being sequentially applied to the gate line, the size of the second data signal for pre-charging may be determined according to the data signal applied to the previous gate line of the gate line to which the second data signal is to be applied.

For example, referring to FIG. 3, a gate on signal having 4 pulses may be input to the second gate line. At this time, the data signal which is input to the plurality of data lines while a first pulse to a third pulse is being applied may be the same as with the data signal to be applied to the plurality of data lines while the gate on signals of the second pulse to the fourth pulse are each being input to the first gate line.

Thus, through this method, the timing controller 140 may control the gate driver 120 and the data driver 130 to cause the display panel 110 to display an image frame.

Accordingly, in the case of FIG. 3, for pre-charging and over driving, the time section to which the gate on signal is to be applied may be determined based on the second frame frequency.

FIG. 4 is a diagram illustrating a case in which a gate on signal in which a pulse width is determined is applied to a gate line based on a first frame frequency and a second frame frequency.

In describing FIG. 4, descriptions of parts overlapping with FIG. 3 will be omitted for convenience of description.

The timing controller 140 may control the gate driver 120 to provide the gate on signal having a specific pulse width to the gate line.

In this case, the gate driver 120 may sequentially apply the gate on signal having a specific pulse width to the plurality of gate lines as in FIG. 4.

For example, as in FIG. 4, the gate driver 120 may apply the gate on signal to the first gate line from among the 2160 gate lines, and the pulse width of the gate on signal being applied to the gate line may be determined based on the first frame frequency and the second frame frequency.

Specifically, the pulse width of the gate on signals 310 and 320 may be the same as {(the pulse width*n based on the first frame frequency)(n is a natural number)(310)+(the pulse width based on the second frame frequency)(310)}.

At this time, if the pulse width based on the first frame frequency is 7.2 μs, and the pulse width based on the second frame frequency is 3.6 μs, the gate driver 120 may apply the gate on signal having a pulse width of (7.2 μs*3)+3.6 μs=25.2 μs to the first gate line.

Then, the gate driver 120 may apply, after a predetermined time has passed, that is, after about 7.2 μs has passed, a gate on signal which is the same as the gate on signal applied to the first gate line to the second gate line. Through this method, the gate driver 120 may sequentially apply the gate on signal to the 2160 gate lines in total.

Then, the timing controller 140 may control the data driver 130 to apply the second data signal for pre-charging to the pixels for a first time section 310 from among the time the gate on signal is being applied to the gate line and apply the first data signal for over driving to the pixels for a second time section 320 excluding the first time section. In this case, the length of the first time section may be determined based on the first frame frequency a described above.

The size of the first data signal for over driving may be varied according to the gray scale value displayed in the pixel, and the size of the first data signal according to the gray scale may be predetermined and pre-stored in the storage 400.

Thus, through this method, the timing controller 140 may control the gate driver 120 and the data driver 130 to cause the display panel 110 to display the image frame.

Accordingly, as in FIG. 4, while the time section in which the gate on signal for pre-charging is applied may be determined by the first frame frequency, the time section in which the gate on signal for over driving may be determined based on the second frame frequency.

FIG. 5 is a diagram illustrating an example of a gate signal with a pulse width determined being applied based on a second frame frequency according to an embodiment of the disclosure.

In describing FIG. 5, descriptions overlapping with FIGS. 3 and 4 will be omitted for convenience of description.

The timing controller 140 may control the gate driver 120 to provide the gate on signal having a specific pulse width to the gate line.

In this case, the gate driver 120 may sequentially apply the gate on signal having a specific pulse width to the plurality of gate lines as in FIG. 5.

For example, as in FIG. 5, the gate driver 120 may apply the gate on signal to the first gate line from among the 2160 gate lines, and the pulse width of the gate on signal being applied to the gate line at this time may be determined by the second frame frequency.

Specifically, the pulse width of the gate on signals 410 and 420 may be the same as (the pulse width*n based on the second frame frequency)(n is a natural number)}.

At this time, if the pulse width based on the second frame frequency is 3.6 μs, the gate driver 120 may apply the gate on signal having a pulse width of 3.6 μs*4=14.4 μs to the first gate line.

Then, the gate driver 120 may apply, after a predetermined time has passed, that is, after about 7.2 μs has passed, a gate on signal which is the same as the gate on signal applied to the first gate line to the second gate line. By way of this method, the gate driver 120 may sequentially apply the gate signal to the 2160 gate lines in total.

Then, the timing controller 140 may control the data driver 130 to apply the second data signal for pre-charging to the pixels for the first time section 410 while the gate on signal is being applied to the gate line and apply the first data signal for over driving to the pixels for the second time section 420 excluding the first time section. In this case, the length of the first time section may be determined based on the second frame frequency as described above.

The size of the first data signal for over driving may be varied according to the gray scale value displayed in the pixel, and the size of the first data signal according to the gray scale may be predetermined and pre-stored in the storage 400.

Accordingly, in the case of FIG. 5, the time section to which the gate on signals for pre-charging and over driving may be determined based on the second frame frequency.

Thus, in the case of FIGS. 3 to 5, based on the data signal for over driving being applied at the second frame frequency for a determined time, the response rate of the pixels may be increased.

Figure 6:
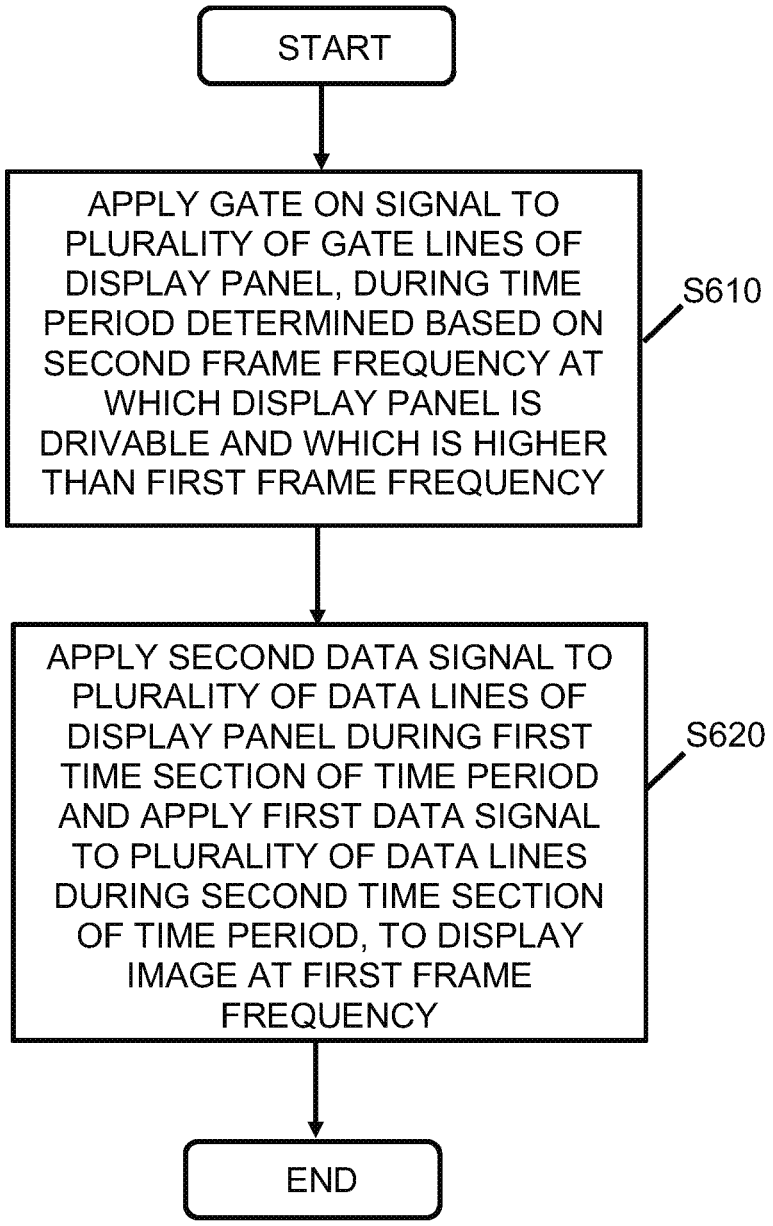
FIG. 6 is a diagram illustrating an image display method of a display device according to an embodiment.

FIG. 6 is a diagram illustrating an image display method of a display device according to an embodiment of the disclosure.

First, the gate on signal may be applied through the plurality of gate lines of the display panel during a time period determined based on the second frame frequency which is higher the first frame frequency(S610).

Then, the data signal may be applied through the plurality of data lines of the display panel to display an image frame at the first frame frequency (S620). The gate on signal may be applied for the time period determined based on the second frame frequency of the plurality of gate lines, and the data signal over driven to the plurality of data lines may be applied. The second data signal may be applied to the plurality of data lines of the display panel during the first time section of the time period and a first data signal may be applied to the plurality of data lines during a second time section of the time period.

In addition, the display panel may be drivable at the second frame frequency which is higher than the first frame frequency.

The time in which the data signal is applied may be determined based on the second frame frequency and the number of the plurality of gate lines.

In addition, the first frame frequency may be smaller than the second frame frequency.

In step 610, the gate on signal may be sequentially applied to the plurality of gate lines, and in step 620, the data signal may be applied to pixels to which the gate on signal is applied from among the plurality of pixels.

The data signal may include the first data signal for over driving of the pixels and the second data signal for pre-charging of the pixels before over driving.

In this case, in step S610, the gate on signal comprised of the plurality of pulses having a predetermined time interval may be applied to the gate line, and in step 620, the second data signal may be applied to the pixels while the remaining pulses other than the last pulse from among the plurality of pulses are being applied to the gate line, and the first data signal may be applied to the pixels while the last pulse is being applied to the gate line. The pulse width of each of the plurality of pulses may be determined based on the second frame frequency.

In addition, in step S610, the gate on signal having a specific pulse width may be applied to the gate line, and in step S620, the second data signal may be applied to the pixels for the first time section from among the time in which the gate signal is applied to the gate line, and the first data signal may be applied to the pixels for the second time section excluding the first time section. The length of the first time section may be determined based on the first frame frequency.

In addition, in step 610, the gate on signal having a specific pulse width may be applied to the gate line, and in step 620, the second data signal may be applied to the pixels during the first time section from among the time the gate on signal is applied to the gate line, and the first data signal may be applied to the pixels during the second time section excluding the first time section. The length of the first time section may be determined based on the second frame frequency.

The detailed method of displaying an image through the display device in this method has been described above.

The various embodiments described above may be implemented in a recordable medium which is readable by a computer or a device similar to the computer using software, hardware, or the combination of software and hardware. By hardware implementation, the embodiments of the disclosure may be implemented using at least one from among application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, or electric units for performing other functions. In some cases, embodiments described herein may be implemented by the processor itself. According to a software implementation, embodiments such as the procedures and functions described herein may be implemented with separate software modules. Each of the above-described software modules may perform one or more of the functions and operations described herein.

The computer instructions for performing operations in the display device according to the various embodiments described above may be stored in a non-transitory computer-readable medium. The computer instructions stored in this non-transitory computer-readable medium may cause a specific device to perform the processing operations in the display device according to the above-described various embodiments when executed by the processor of the specific device.

The non-transitory computer readable medium may refer to a medium that stores data semi-permanently rather than storing data for a very short time, such as a register, a cache, a memory, or the like, and is readable by a device. Specific examples of the non-transitory computer readable medium may include, for example, and without limitation, a compact disc (CD), a digital versatile disc (DVD), a hard disc, a Blu-ray disc, a USB, a memory card, a ROM, and the like.

While the disclosure has been illustrated and described with reference to various example embodiments thereof, the disclosure is not limited to the specific embodiments described. It will be understood by those skilled in the art that various changes in form and details may be made therein without departing from the spirit and scope of the disclosure.

INDUSTRIAL APPLICABILITY

-

SEQUENCE LIST FREE TEXT

-

What is claimed is:

1. A display device, comprising:

a display panel comprising a plurality of pixels;

a gate driver to apply a gate on signal to a plurality of gate lines of the display panel;

a data driver to apply a data signal to a plurality of data lines of the display panel; and a timing controller configured to control the gate driver and the data driver to display an image frame at a first frame frequency, wherein the display panel is drivable at a second frame frequency which is higher than the first frame frequency, and wherein the timing controller is configured to control the gate driver to apply the gate on signal to the plurality of gate lines during a time period determined based on the second frame frequency and control the data driver to apply an over driven data signal to the plurality of data lines during the time period, to display the image frame at the first frame frequency.

2. The display device of claim 1, wherein a length of the time period in which the data signal is applied is determined based on the second frame frequency and a number of the plurality of gate lines.

3. The display device of claim 1, wherein the timing controller is configured to control the gate driver to sequentially apply the gate on signal to the plurality of gate lines, control the data driver to apply the data signal to pixels applied with the gate on signal from among the plurality of pixels, to display the image frame at the first frame frequency.

4. The display device of claim 3, wherein the data signal comprises a first data signal for over driving of the pixels and a second data signal for pre-charging of the pixels before the over driving.

5. The display device of claim 4, wherein the timing controller is configured to control the gate driver to apply the gate on signal comprised of a plurality of pulses with a predetermined time interval to a gate line, and control the data driver to apply the second data signal to the pixels while pulses excluding a last pulse from among the plurality of pulses are applied to the gate line and apply the first data signal to the pixels while the last pulse is applied to the gate line, and wherein a pulse width of each of the plurality of pulses is determined based on the second frame frequency.

6. The display device of claim 4, wherein the timing controller is configured to control the gate driver to provide the gate on signal with a specific pulse width corresponding to the time period to a gate line, and control the data driver to apply the second data signal to the pixels for a first time section from among a time in which the gate on signal is applied to the gate line and apply the first data signal to the pixels for a second time section excluding the first time section, and wherein a length of the first time section is determined based on the first frame frequency.

7. The display device of claim 4, wherein the timing controller is configured to control the gate driver to provide the gate on signal with a specific pulse width corresponding to the time period to a gate line, and control the data driver to apply the second data signal to the pixels for a first time section from among a time in which the gate on signal is applied to the gate line and apply the first data signal to the pixels for a second time section excluding the first time section, and wherein a length of the first time section is determined based on the second frame frequency.

8. The display device of claim 1, wherein the data signal comprises a first data signal for over driving of pixels and a second data signal for pre-charging of the pixels before the over driving, and wherein the timing controller is configured control the data driver to apply the second data signal to the pixels during a first time section in the time period in which the gate on signal is applied to a gate line and apply the first data signal to the pixels during a second time section, following the first time section, in the time period in which the gate on signal is applied to the gate line.

9. An image displaying method of a display device comprising a display panel comprising a plurality of pixels, the image displaying method comprising:

applying a gate on signal to a plurality of gate lines of the display panel; and applying a data signal to a plurality of data lines of the display panel to display an image frame at a first frame frequency, wherein the display panel is drivable at a second frame frequency which is higher than the first frame frequency, and wherein the applying the gate on signal comprises applying the gate on signal to the plurality of gate lines during a time period determined based on the second frame frequency to display the image frame at the first frame frequency, and the applying the data signal comprises applying over driven data signals to the plurality of data lines during the time period to display the image frame at the first frame frequency.

10. The image displaying method of claim 9, wherein a length the time period in which the data signal is applied is determined based on the second frame frequency and a number of the plurality of gate lines.

11. The image displaying method of claim 9, wherein the applying the gate on signal comprises sequentially applying the gate on signal to the plurality of gate lines, and wherein the applying the data signal comprises applying the data signal to pixels applied with the gate on signal from among the plurality of pixels.

12. The image displaying method of claim 11, wherein the data signal comprises a first data signal for over driving of the pixels and a second data signal for pre-charging of the pixels before the over driving.

13. The image displaying method of claim 12, wherein the applying the gate on signal comprises applying the gate on signal comprised of a plurality of pulses with a predetermined time interval to a gate line, wherein the applying the data signal comprises applying the second data signal to the pixels while pulses excluding a last pulse from among the plurality of pulses are applied to the gate line, and applying the first data signal to the pixels while the last pulse is applied to the gate line, and wherein a pulse width of each of the plurality of pulses is determined based on the second frame frequency.

14. The image displaying method of claim 12, wherein the applying the gate on signal comprises applying the gate on signal with a specific pulse width corresponding to the time period to a gate line, wherein the applying the data signal comprises applying the second data signal to the pixels for a first time section from among a time in which the gate on signal is applied to the gate line, and applying the first data signal to the pixels for a second time section excluding the first time section, and wherein a length of the first time section is characterized by being determined based on the first frame frequency.

15. The image displaying method of claim 12, wherein the applying the gate on signal comprises applying the gate on signal with a specific pulse width corresponding to the time period to a gate line, wherein the applying the data signal comprises applying the second data signal to the pixels for a first time section from among a time in which the gate on signal is applied to the gate line, and applying the first data signal to the pixels for a second time section excluding the first time section, and wherein a length of the first time section is characterized by being determined based on the second frame frequency.

16. The image displaying method of claim 9, wherein the data signal comprises a first data signal for over driving of pixels and a second data signal for pre-charging of the pixels before the over driving, and wherein the applying the data signal comprises applying the second data signal to the pixels during a first time section in the time period in which the gate on signal is applied to a gate line and applying the first data signal to the pixels during a second time section, following the first time section, in the time period in which the gate on signal is applied to the gate line.

* * * * *